US006685101B1

(12) United States Patent
Weber et al.

(10) Patent No.: US 6,685,101 B1
(45) Date of Patent: Feb. 3, 2004

(54) RAILWAY FASTENING CLIP

(75) Inventors: Andre C. Weber, Fochville (ZA); Marius S. Strydom, Fochville (ZA)

(73) Assignee: Matthys Pretorius Strydom, Fochville (ZA)

( * ) Notice: Subject to any disclaimer, the term of this patent is extended or adjusted under 35 U.S.C. 154(b) by 0 days.

(21) Appl. No.: 10/130,029

(22) PCT Filed: Nov. 10, 2000

(86) PCT No.: PCT/ZA00/00212

§ 371 (c)(1),
(2), (4) Date: Aug. 26, 2002

(87) PCT Pub. No.: WO01/34911

PCT Pub. Date: May 17, 2001

(30) Foreign Application Priority Data

Nov. 12, 1999 (ZA) ..... 99/7080

(51) Int. Cl.[7] ..... E01B 9/00
(52) U.S. Cl. ..... 238/351
(58) Field of Search ..... 238/310, 348, 238/349, 351, 352

(56) References Cited

U.S. PATENT DOCUMENTS

| | | | | | |
|---|---|---|---|---|---|
| 1,422,340 | A | * | 7/1922 | Cooper | 238/349 |
| 2,150,259 | A | * | 3/1939 | Woodings | 238/349 |
| 2,257,641 | A | * | 9/1941 | Muller | 411/447 |
| 2,265,745 | A | * | 12/1941 | Roscoe | 238/349 |
| 2,324,134 | A | * | 7/1943 | Chidester | 238/349 |
| 2,535,337 | A | * | 12/1950 | Wertz | 238/349 |
| 3,021,076 | A | * | 2/1962 | Finch | 238/321 |
| 3,550,851 | A | * | 12/1970 | Sonneville | 238/349 |
| 3,784,098 | A | * | 1/1974 | Serafin et al. | 238/349 |
| 3,970,248 | A | | 7/1976 | Molyneux | 238/349 |
| 3,986,667 | A | * | 10/1976 | Heim | 238/349 |
| 4,819,870 | A | * | 4/1989 | Clark et al. | 238/351 |
| 4,953,787 | A | * | 9/1990 | Fee | 238/349 |
| 5,820,021 | A | * | 10/1998 | Rex | 238/351 |

FOREIGN PATENT DOCUMENTS

| | | | |
|---|---|---|---|
| CH | 445 540 | 10/1967 | E01B/9/34 |
| DE | 38 20 243 A1 | 2/1990 | E01B/9/30 |
| GB | 1 135 774 | 12/1968 | E01B/9/34 |
| GB | 1 448 982 | 9/1976 | E01B/9/30 |
| GB | 2 034 788 A | 6/1980 | E01B/9/30 |
| NL | 7 312 599 | 3/1974 | E01B/9/30 |
| WO | WO 84/ 02728 | 7/1984 | E01B/3/16 |

OTHER PUBLICATIONS

English language abstract for DE 3820243 Feb. 8, 1990.
International Search Report for PCT/ZA 00/00212: Date Feb. 20, 2001.

* cited by examiner

*Primary Examiner*—Mark T. Le
(74) *Attorney, Agent, or Firm*—Marshall, Gerstein & Borun LLP

(57) ABSTRACT

A railway fastening clip for securing a rail comprises an elongate member (1), formed so as to consist of a first longitudinal leg (2), and a second longitudinal leg (3), the legs being resiliently connected at one end of the member, and an ear formation (4) extending transversely beyond the first leg.

19 Claims, 5 Drawing Sheets

RAILWAY FASTENING CLIP

CROSS-REFERENCE TO RELATED APPLICATIONS

This is the U.S. national phase application of International Application No. PCT/ZA00/00212, filed on Nov. 10, 2000, which claims the benefit of South Africa Patent Application Ser. No. 99/7080, filed Nov. 12, 1999.

TECHNICAL FIELD

This invention relates to a railway fastening clip for securing a rail to a sleeper.

BACKGROUND ART

The use of railway fastening clips to secure rails to sleepers is well known. The sleepers used generally in underground mines, as well as those used in railways in many countries, consist of concrete castings, provided with steel eye formations to allow the securing of rails thereto using steel clips.

The conventional railway fastening clips used in conjunction with such sleepers consist of a steel element formed so as to comprise a spiral including three straight parallel sections, each disposed, in operation, co-linearly with the rail. In operation, the central straight section passes through the eye, and one of the other straight sections passes over a shoulder in the eye while the other exerts a downward force on the base of the rail, thereby securing it in position. In order to achieve the down force necessary to secure the rail to the sleeper, the clips have an arched section which protrudes substantially above the sleeper. The protrusion of the clips renders them vulnerable to impacts, and problems are thus experienced with the breakage and displacement of these clips, often caused by impact from derailed carriages. As clips break, rails become loose, and the risk of further derailments is increased.

In addition, the cost of producing such clips is relatively high, both in terms of the material used and the time and labour expended in forming the clips.

It is accordingly an object of this invention to provide a railway fastening clip which will overcome, or at least reduce the above disadvantages.

DISCLOSURE OF THE INVENTION

According to a first aspect of the invention, there is provided a railway fastening clip for securing a rail to a support, the clip comprising an elongate member, formed so as to consist of a first longitudinal leg; and a second longitudinal leg, the legs being resiliently connected at one end of the member; and an ear formation extending transversely beyond the first leg.

The member may have an upper and a lower side, and the end of the first leg proximate to the connected end may be lower than the second leg.

The legs may be substantially parallel. Alternatively, the first leg may be inclined upwardly by up to 20°.

The free end of each of the legs remote from the connected end of the member may be inclined upwardly. The angle of inclination may be up to 45°, and preferably 4°, and the distance from the end at which the inclination begins may be between 5 and 50 mm and preferably approximately 10 mm.

The ear formation may consist of a loop section connecting the legs.

The part of the loop defining the end of the member may be curved outwardly towards the upper side of the clip.

The first leg may extend beyond the second leg.

The member may be manufactured of steel suitable for oil quenching in production to a hardness of at least 32 Rc, and preferably at least 57 Rc.

According to a second aspect of the invention, there is provided a set of mirrored left and right, substantially as defined above.

According to a third aspect of the invention, there is provided the use of a clip as defined above for securing a rail in position.

BRIEF DESCRIPTION OF THE DRAWINGS

The invention will now be described, by way of non-limiting example only, with reference to the accompanying figures, wherein.

Please note that the same reference numerals are used to indicate corresponding items in the drawings.

MODES FOR CARRYING OUT THE INVENTION

Figure 1:
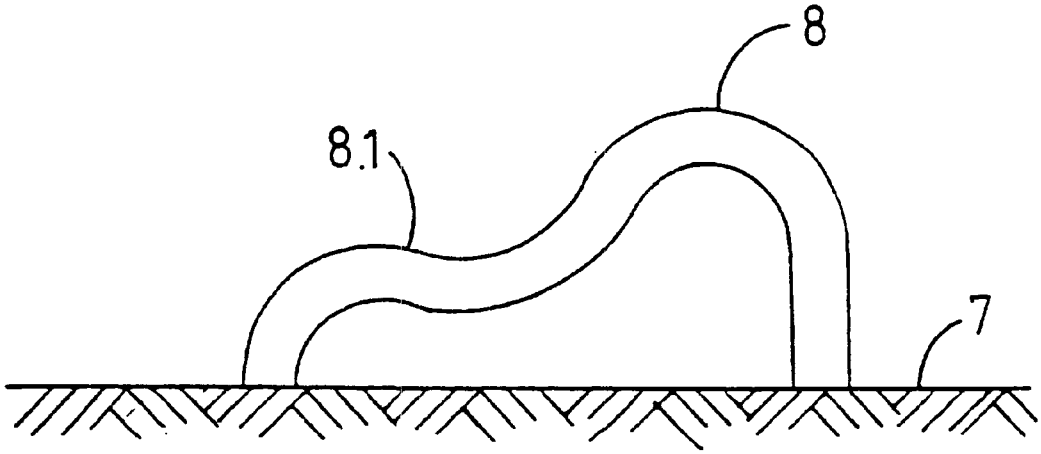
PRIOR ART FIGURE 1
FIG. 1 is a side view of a standard steel eye, set into a concrete sleeper.

FIG. 1 shows a steel eye (8), such as typically used in railways, inset into a sleeper (7). The eye (8) includes a shoulder (8.1).

Figure 2:
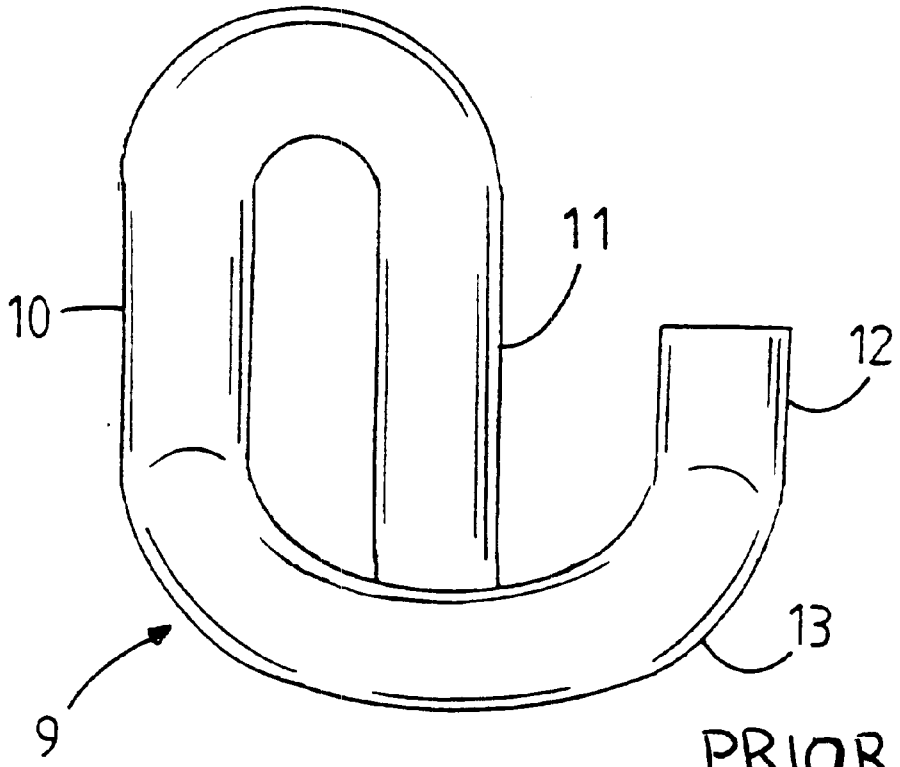
FIGURE 2 PRIOR ART
FIG. 2 is a plan view of a prior art clip.
Figure 3:
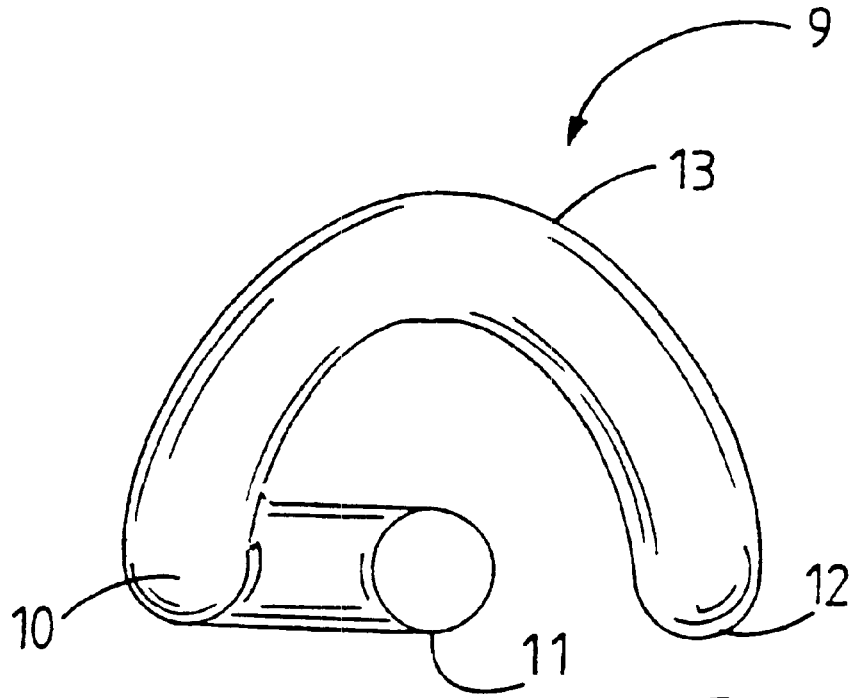
FIGURE 3 PRIOR ART
FIG. 3 is an end view of the clip shown in FIG. 2.

A prior art clip, such as generally used in conjunction with such sleepers is shown in FIGS. 2 and 3 and consists of a steel element (9) formed so as to comprise a spiral including three straight parallel sections (10–12), each disposed, in operation, co-linearly with the rail. In operation, the central straight section (11) passes through the eye (8), and one of the other straight sections passes over the shoulder (8.1) while the other exerts a downward force on the base of the rail, thereby securing it in position. In order to achieve the down force necessary to secure the rail to the sleeper (7), the prior art clip has an arched section (13) which protrudes substantially above the sleeper (7).

Figure 4:
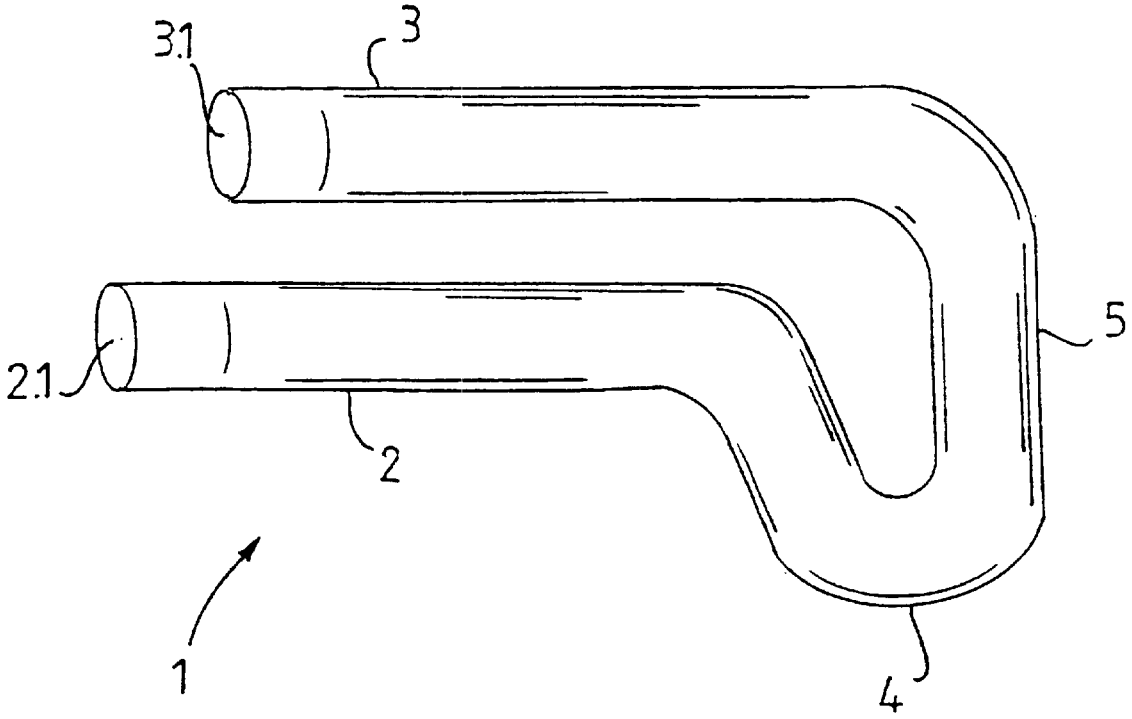
FIG. 4 is a plan view of a clip in accordance with the invention.
Figure 5:
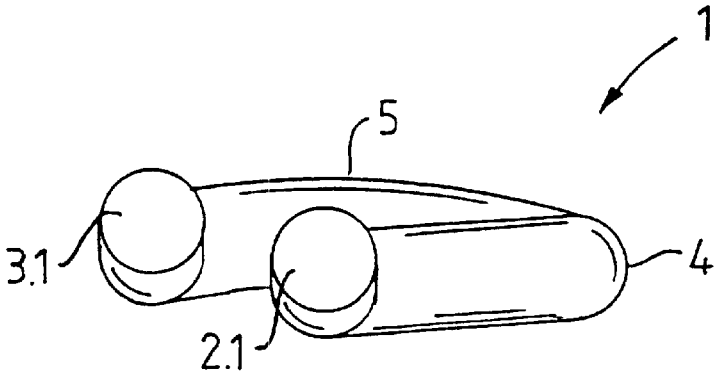
FIG. 5 is an end view of the clip shown in FIG. 4.

A railway fastening clip for securing a rail in accordance with the invention is shown in FIGS. 3 to 5. The clip comprises an elongate member (1), formed so as to consist of a first longitudinal leg (2), and a second longitudinal leg (3), the legs being resiliently connected at one end of the member, and an ear formation (4) extending transversely beyond the first leg.

The member (1) has an upper side (1.1) and a lower side (1.2), and the end of the first leg (2) proximate to the connected end is lower than the second leg (3).

Figure 6:
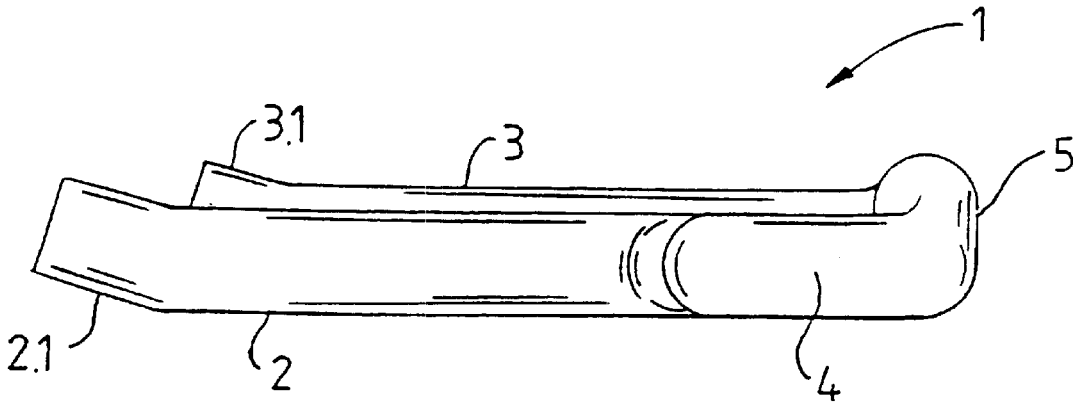
FIG. 6 is a side view of the clip shown in FIG. 5.
Figure 7:
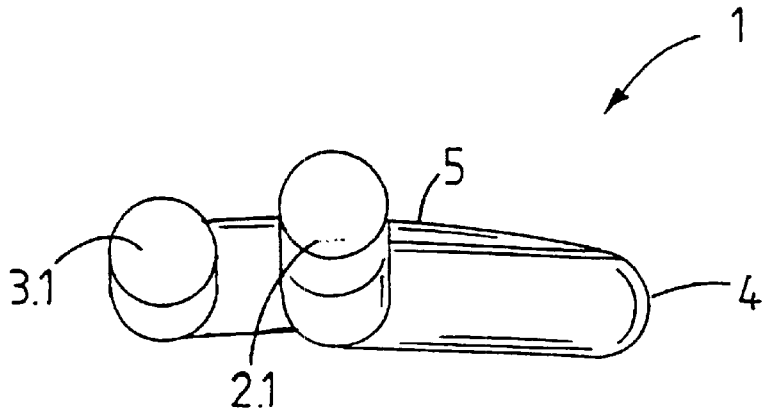
FIG. 7 is an end view of an alternative embodiment of the invention.
Figure 8:
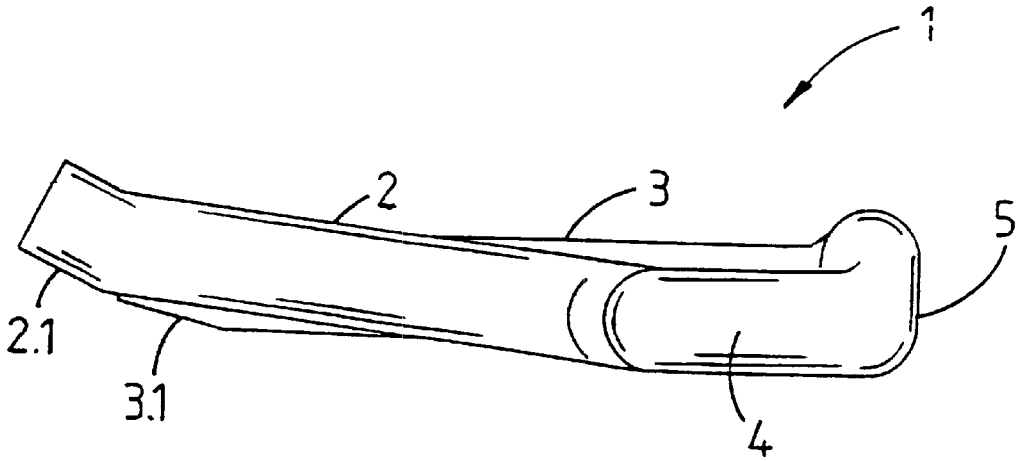
FIG. 8 is a side view of the clip shown in FIG. 7.

In one embodiment of the invention, the first leg (2) and the second leg (3) are substantially parallel. In another embodiment, as shown in FIGS. 6 and 7, the first leg (2) is inclined upwardly by 4°, so as in operation to increase the down-force exerted on the rail. It is envisaged that the inclination could be up to 20°.

In order to prevent accidental displacement of the clip, the free end of each of the first leg (2) and the second leg (3)

remote from the connected end of the member is also inclined upwardly. The angle of inclination is 4° and the distance from the end from which the inclination begins is between 5 and 50 mm and preferably in the region of 10 mm.

The ear formation (4) consists of an loop open (5), connecting the legs.

A part of the loop (5.1), defining the end of the member, is slightly curved outwardly towards the upper side (1.1) of the clip.

The length of the first leg (2) extends beyond that of the second leg (3).

The member is manufactured of steel suitable for oil quenching in production to a hardness of 57 Rc. It is envisaged that a hardness of at least 32 Rc could suffice.

A mirrored left and right set of clips, substantially as described above is provided in accordance with the invention.

Figure 9:
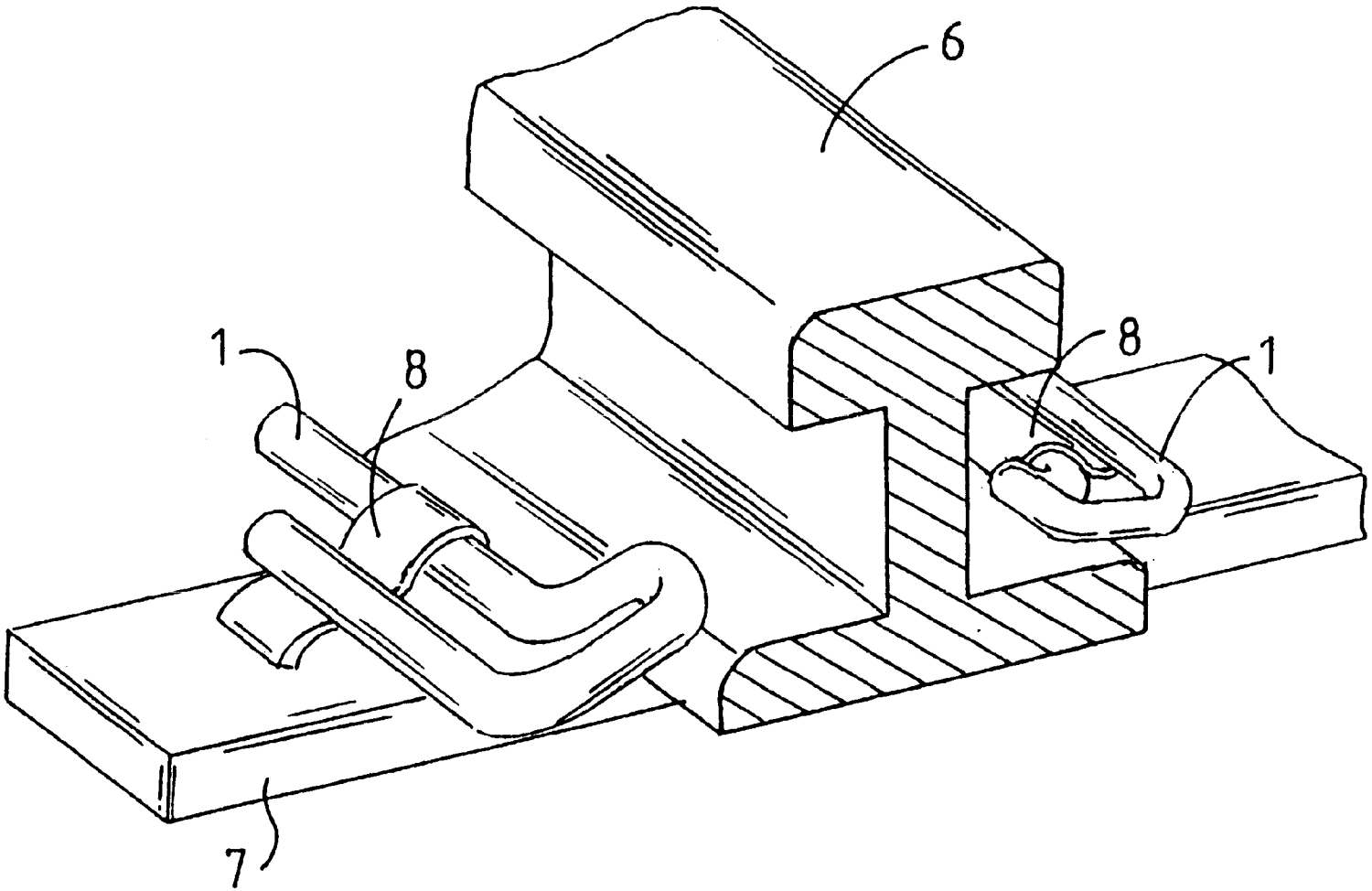
FIG. 9 is a perspective view of a set of clips in accordance with the invention, shown here in operation securing a rail to a sleeper.

FIG. 9 shows a pair of clips (1), as described above, securing a rail (6) to a sleeper (7) by passing through steel eye formations (8).

It is anticipated that the use of a clip substantially as described above will overcome or at least reduce the disadvantages stated above.

It will be appreciated that many embodiments of the invention could be performed without departing from the scope of the invention as defined in the claims hereunder.

What is claimed is:

1. A railway fastening clip securing a rail to a support, in the clip comprising:

an elongate member, the member formed so as to include a first longitudinal leg and a second longitudinal leg, the first and second legs being resiliently connected at an end of the member, the elongate member sized and extending parallel to the rail to secure the rail to the support; and an ear formation extending transversely beyond the first leg, the ear formation being sized and partially overlying the rail to silently hold the rail on the support when the elongate member is positioned to secure the rail to the support.

2. A clip as claimed in claim 1, the member having an upper side and a lower side, an end of the first leg proximate to the end of the member being lower than the second leg.

3. A clip as claimed in claim 1, wherein the first and second legs each include an upwardly inclined free end, the free end of each of the legs remote from the end of the member.

4. A clip as claimed in claim 3, wherein in the angle of inclination is less than 40°.

5. A clip as claimed in claim 4, wherein in the angle of inclination is 4°.

6. A clip as claimed in claim 3, wherein the distance from the free end of each of the legs at which the inclination begins is between 5 and 50 mm.

7. A clip as claimed in claim 6, wherein the distance from the free end of each of the legs at which the inclination begins is 10 mm.

8. A clip as claimed in claim 1, the ear formation comprising a loop section connecting the legs.

9. A clip as claimed in claim 8, wherein a part of the loop section defining the end of the member is curved outwardly towards an upper side of the clip.

10. A clip as claimed in claim 1, the length of the first leg extending beyond the second leg.

11. A clip as claimed in claim 1, wherein the member is manufactured of steel suitable for oil quenching in production to a hardness of at least 32 Rc.

12. A clip as claimed in claim 11, wherein the member is manufactured of steel suitable for oil quenching in production to a hardness of 57 Rc.

13. A set of mirrored, left and right orientated clips securing a rail to a support, each of the left and right clips comprising an elongate member formed so as to include a first longitudinal leg and a second longitudinal leg, each of the first and second legs resiliently connected at one end of the member, and an ear formation extending transversely beyond the first leg, the elongate member of each clip being sized and extending parallel to the rail to secure the rail to the support, and the elongate member of each clip being oriented substantially parallel to the elongate member of the other clip when each clip is positioned to secure the rail to the support.

14. A method of securing a rail to a sleeper comprising the steps of providing a clip comprising an elongate member, the member formed so as to include a first longitudinal leg and a second longitudinal leg, the first and second legs resiliently connected at one end of the member, the member further having an ear formation extending transversely beyond the first leg, and using the clip to secure the rail to the sleeper by securely connecting the elongate member to the sleeper in an orientation substantially parallel with the rail, wherein connecting the elongate member to the sleeper causes a portion of the ear formation to resiliently overlie the rail such that the rail is disposed between the ear formation and the sleeper.

15. A railway fastening clip securing a rail to a support, the clip comprising:

a first elongated leg having a first end and a second end;

a second elongated leg having a first end and a second end, a major portion of the first leg parallel to a major portion of the second leg;

a resilient loop joining the second ends of the first and second legs, the resilient loop extending transversely from the first leg, the loop extending only to one side of the first leg;

at least a portion of the loop forming an ear, the ear extending transversely from the second leg, the ear extending only to one side of the second leg; and wherein, one of the first ends of the first and second legs extends through a clip holder, and the first and second legs are oriented parallel to the rail.

16. A clip as claimed in claim 15, in combination with the clip holder and a sleeper, the sleeper adapted to receive the rail, the clip holder having an aperture sized to receive one of the first and second legs parallel to the rail, the ear sized to overlie a portion of the rail.

17. A clip as claimed in claim 15 wherein each of the first and second legs incline upwardly adjacent the second ends.

18. A clip as claimed in claim 17, wherein the angle of inclination is between 4° and 40°.

19. A railway fastening clip securing a rail to a support, the clip comprising:

a straight first leg having a first end and an inclined second end;

a straight second leg having a first end and an inclined second end, the first and second legs joined by a resilient loop, the loop extending transversely from the legs in only a single direction; and wherein, at least a portion of the loop forms an ear overlying a portion of the rail, and at least one of the legs is disposed parallel to the rail.

* * * * *

UNITED STATES PATENT AND TRADEMARK OFFICE

CERTIFICATE OF CORRECTION

PATENT NO. : 6,685,101 B1 
DATED : February 3, 2004
INVENTOR(S) : Andre C. Weber et al.

It is certified that error appears in the above-identified patent and that said Letters Patent is hereby corrected as shown below:

Column 3,
Line 28, delete “in”.
Line 39, delete “silently” and insert instead -- resiliently --.
Lines 48 and 50, delete “wherein in” and insert instead -- wherein --.

Signed and Sealed this

Eighteenth Day of January, 2005

JON W. DUDAS
*Director of the United States Patent and Trademark Office*